US005960810A

United States Patent [19]

Douglas

[11] Patent Number: 5,960,810

[45] Date of Patent: Oct. 5, 1999

[54] LIME SLURRY INJECTION SYSTEM AND METHOD FOR SEPTIC PUMPERS

[76] Inventor: Matthew W. Douglas, W. 336 Town Center Rd., Brodhead, Wis. 53520

[21] Appl. No.: 09/195,317

[22] Filed: Nov. 18, 1998

Related U.S. Application Data

[60] Provisional application No. 60/065,746, Nov. 20, 1997.

[51] Int. Cl.[6] ..... B65B 31/00

[52] U.S. Cl. ..... 137/14; 137/240; 137/209; 137/572; 137/351; 405/263

[58] Field of Search ..... 137/899, 551, 137/571, 240, 209, 14, 572; 405/263

[56] References Cited

U.S. PATENT DOCUMENTS

| | | | |
|---|---|---|---|
| 3,976,087 | 8/1976 | Bolton et al. | 137/240 |
| 4,119,110 | 10/1978 | Stone | 137/240 |
| 4,142,545 | 3/1979 | Billigmeier | 137/240 |
| 4,329,090 | 5/1982 | Teagu et al. | 405/263 |
| 4,497,334 | 2/1985 | Wolf et al. | 137/240 |
| 4,554,941 | 11/1985 | Coon et al. | 137/240 |
| 4,735,225 | 4/1988 | Huvteau | 137/240 |
| 5,022,428 | 6/1991 | Vilines | 137/351 |
| 5,277,491 | 1/1994 | Burnett et al. . | |
| 5,378,374 | 1/1995 | Anderson . | |
| 5,507,572 | 4/1996 | Shields et al. | 405/263 |
| 5,531,240 | 7/1996 | Kelada | 137/209 |
| 5,878,767 | 3/1999 | Etling et al. | 137/351 |

OTHER PUBLICATIONS

Porta Batch product literature of Chemical Lime Co., Ft. Worth Texas.

Slurry, Liquidator product literature of Slurry Liquidator Corp., Mancos CO.

*Primary Examiner*—A. Michael Chambers

*Attorney, Agent, or Firm*—John V. Stewart

[57] ABSTRACT

A system of three tanks and associated fluid communication lines and valves added to a conventional septage pumper/hauler truck to carry a supply of lime slurry and inject it into the septage hauling tank 1 in measured doses. Air vacuum or pressure is used for moving the fluids between tanks without fluid pumps. The three tanks of the invention include a lime slurry carrying tank 3, a lime slurry dosing tank 7, and a water tank 5 for flushing the system. Compressed air 37 is applied to each of these tanks as needed to push the fluid contents through the connecting pipes. An air vacuum that is normally provided to the main tank 1 for loading septage is also employed in the invention to load tank 3 with lime slurry. By manipulating the valves in an appropriate sequence, the dosing tank is filled from the lime slurry carrying tank, then the slurry in the dosing tank is injected into the septage carrying tank simultaneously with septage for mixing. The ph of the septage is then tested, and the dosage repeated if necessary until the required level is achieved. At the end of the day, the valves are manipulated in another sequence to flush lime slurry from the tanks and pipes with water.

7 Claims, 6 Drawing Sheets

LIME SLURRY INJECTION SYSTEM AND METHOD FOR SEPTIC PUMPERS

CROSS-REFERENCE TO RELATED APPLICATIONS

This application claims the benefit of U.S. Provisional Application Ser. No. 60/065,746, filed Nov. 20, 1997.

BACKGROUND OF THE INVENTION

1. Field of the Invention

This invention relates to the treatment of septage with a lime slurry after the septage has been removed from a septic tank and before the septage is expelled from the septage transport vehicle's containment tank onto the ground.

2. Description of Prior Art

The U.S. Environmental Protection Agency (EPA) enacted regulation #503, which requires all septage land spreaders in the U.S. to treat raw septage with lime prior to dumping. The ph level of the septage must be raised to at least 12 for at least ½ hour to kill pathogens and their vectors (insects, rodents, etc), and to reduce odors prior to land spreading of the treated septage. There is no prior mechanism to facilitate such treatment, so I have invented the present system and process disclosed in this application, wherein I describe the parts and operation of the invention.

U.S. Pat. No. 5,057,572 (Shields) discloses a "Method and Apparatus for Supplying a Continuous Product Stream of Lime Slurry to a Remote Site". It comprises a primary tank for mixing and dispensing lime slurry, and a secondary tank to be filled from the primary tank. When the primary tank is empty, the user obtains slurry from the secondary tank while the primary tank is being refilled and agitated. This allows work to progress continuously at a steady pace, even while a new batch of slurry is being prepared. The purpose and design of this invention is for continuous lime application to an area.

In contrast, the purpose and design of the present invention is for dosing lime slurry into the septage hauling tank of a septic truck to meet EPA regulations for land spreading. It uses simpler hardware that offers high reliability, low maintenance, and inexpensive manufacture. It uses only passive hardware in the tanks and lines. No pumps, electric circuits, or electronics are needed. Only compressed air and vacuum air are used, which are already available on a conventional septic truck. Thus, it offers low initial cost and low maintenance expenses. It is small and light enough to add to existing septic trucks, and it offers maximum flexibility of operation.

SUMMARY OF THE INVENTION

The main objective of this invention is the provision of safe and effective means for mixing lime with septage on the site of septage removal from a septic tank to meet EPA regulation #503 before spreading the septage on the ground at a disposal and recycling site. Another objective is simple manufacture from standard components. Other objectives include compactness for attachment to existing septage hauling trucks, self-sufficiency after departure from a staging area, including internal water rinsing means, and provision of discrete dosages of lime slurry to the main septage-carrying tank.

These objectives are achieved by a system of three tanks and associated fluid communication lines and valves added to a conventional septage pumper/hauler truck to carry a supply of lime slurry and inject it into the septage hauling tank 1 in measured doses. Air vacuum or pressure is used for moving the fluids between tanks without fluid pumps. The three tanks of the invention include a lime slurry carrying tank 3, a lime slurry dosing tank 7, and a water tank 5 for flushing the system. Compressed air 37 is applied to each of these tanks as needed to push the fluid contents through the connecting pipes. An air vacuum that is normally provided to the main tank 1 for loading septage is also employed in the invention to load tank 3 with lime slurry. By manipulating the valves in an appropriate sequence, the dosing tank is filled from the lime slurry carrying tank, then the slurry in the dosing tank is injected into the septage carrying tank simultaneously with septage for mixing. The ph of the septage is then tested, and the dosage repeated if necessary until the required level is achieved. At the end of the day, the valves are manipulated in another sequence to flush lime slurry from the tanks and pipes with water.

REFERENCE NUMBERS

Figure 1:
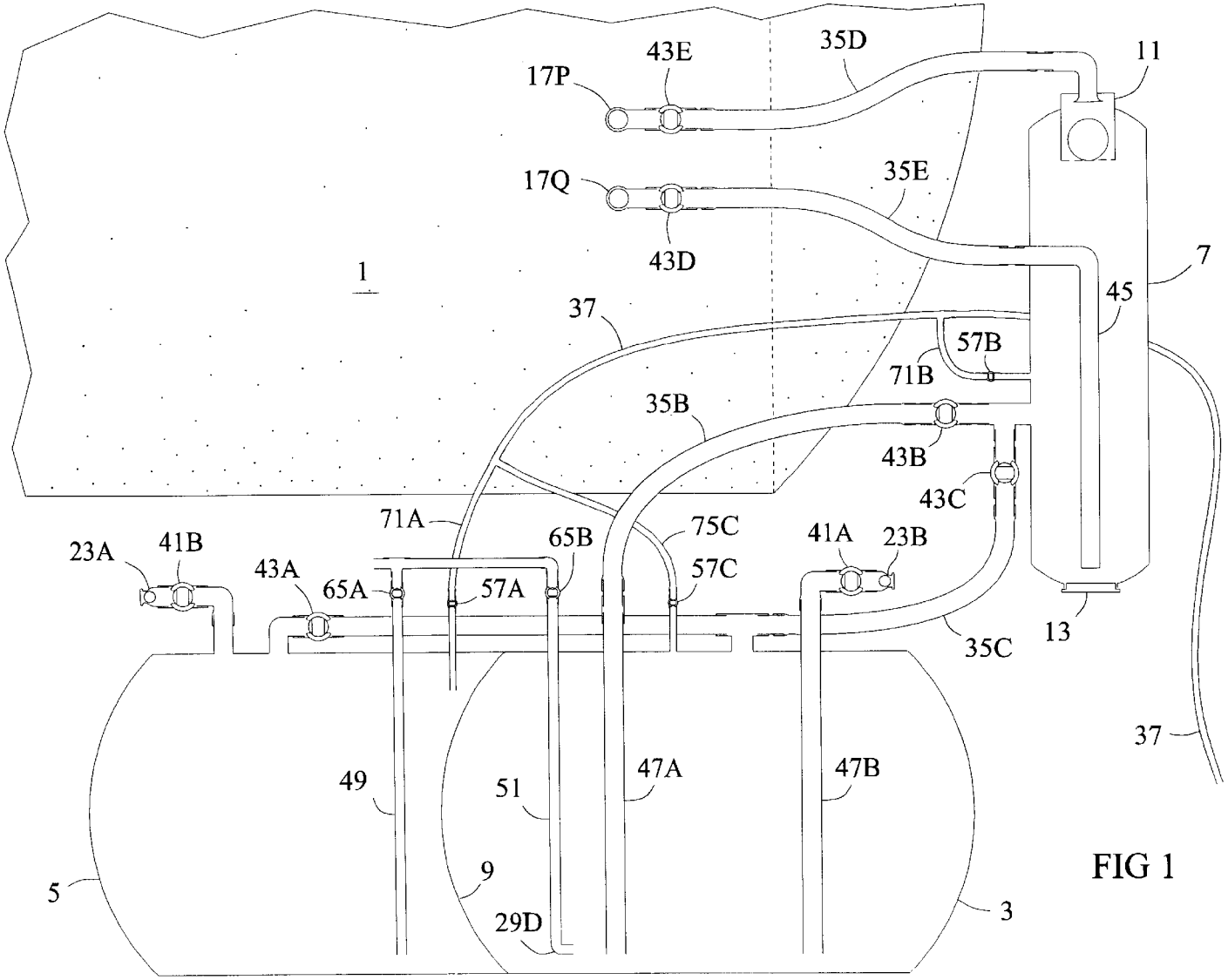
FIG. 1 is a schematic side view of the invention. All lines and tanks are shown in section except for the septage tank 1.

1. Main septic pumping/hauling tank of septic pumper truck. The invention is attached to this tank via two hoses 35D and 35E, and to the pumper truck frame via plates or angle-iron welded to the tanks of the invention and bolted to the truck frame at available mounting sites depending on the individual truck.
3. Lime slurry containment and carrying tank.
5. Water containment and carrying tank.
7. Dosing tank.
9. Curved wall separator between water and lime slurry containment and carrying tanks.
11. Automatic shutoff float valve with hollow stainless steel ball and seat.
13. Male threaded 2 inch diameter steel plug.
15. 2 inch diameter female threaded "plug seat".
17. 17A through 17Q designate appropriate sized holes in tanks. To prevent confusion there is no hole designated 170.
19. 1.5 inch "hose barb" with 90 degree angle.
21. 21A through 21N designate standard hose barbs of appropriate dimensions, threaded on one end and barbed on the other end for hose connections.
23. 23A and 23B are 2 inch quick coupling connectors.
25. 25A and 25B are 2 inch pipe elbows male threaded on one end, female threaded on the other end.
27. 27A through 27C are 1.5 inch pipe elbows male threaded on one end, female threaded on the other (welded) end.

29. 29A through 29F are ¾ inch pipe elbows male threaded on one end and female threaded on the other end.
33. ½×1×2 inch steel pad.
35. 35A through 35E are 1.5 inch high pressure/vacuum hoses made of steel reinforced rubber.
37. Standard air line pressure hose for compressed air. This comes from a pressure regulator on the air-brake system of the truck. The regulator reduces the pressure to about 60 PSI. If the truck does not have air brakes, an air compressor is needed.
38. Vacuum air source on truck. This is standard equipment on septic trucks for drawing septage into the main tank.
39. One-way air valve to prevent residual air pressure in the lime slurry carrying tank from pushing slurry into the truck air-brake system when the truck engine is stopped.
41. 41A and 41B are 2 inch ball valves with female threads on each end.
43. 43A through 43E are 1.5 inch ball valves with female threads on each end.
44. 1.5 inch pipe nipple.
45. 1.5 inch steel pipe with male threads on one end.
46. 1.5 inch pipe elbow with two female ends.
47. 47A and 47B are 1.5 inch and 2 inch (in that order) steel pipe with male threads on one end.
49. ¾ inch steel pipe with male thread on one end.
50. ¾ inch steel pipe with male thread on one end. It is long enough (about 3 inches) to reach the water level in a full water tank for flushing the air lines with water back to the slurry carrying tank and dosing tank.
51. ¾ inch steel pipe male threaded on both ends.
53. 53A and 53B are ¾ inch steel pipes with male threads on both ends.
57. 57A through 57C are ¾ inch air line ball valves.
59. 59A and 59B are 1.5 inch pipe "T"s with female thread on all ends.
61. ¾ inch steel pipe with male thread on one end.
63. Standard ¾ inch pipe union.
65. 65A through 65D are ¾ inch ball valves with female threaded ends.
67. 67A through 67C are ¾ inch pipe "T"s with female threaded ends.
69. ¾ inch water hose fitting, male threaded both ends. A water hose is normally attached to this fitting at all times for general rinsing using water from tank 5.
71. 71A and 71B are ¾ inch high pressure lines. These are preferably larger than standard airline to allow a higher air flow rate among tanks 3, 5, and 7. After the slurry tank 3 is pressurized, and the dosing tank 7 is filled with slurry, the compressed air in the slurry carrying tank 3 can be transferred to the dosing tank rapidly through line 71B rather than waiting for a volume of air from the air source. This speeds the dosing step. The large line 71A to the water tank is useful for this purpose and for back-flushing the air lines with water.
73. 73A and 73B are 1.5 inch pipe nipples.
75. 75A, 75B, and 75C are ¾ inch pipe nipples.
77. 77A and 77B are 1.5 inch female pipe couplers.

DESCRIPTION OF THE INVENTION

Connections of the Parts

1. The main septic pumping/hauling tank 1 is normally mounted on a septic truck, and is connected to the invention through holes 17P and 17Q by welding pipe elbows 27B and 27C to those holes. The holes are 7 inches apart, one above the other.
2. Elbow 25A is welded to tank 5 at hole 17N with its male threaded end facing outward away from tank 1 and toward the operator.
3. Elbow 27*a* is welded to tank 5 at hole 17*m* with its male threaded end facing outward away from tank 1 and toward the operator.
4. Pipe 49 is inserted into hole 17L so that its unthreaded end is ½ inch from the bottom of tank 5, then welded to tank 5 at hole 17L with the male threads remaining outside the tank.
5. The female threaded end of elbow 29E is welded to tank 5 at hole 17K. Optionally, a short length of pipe may be threaded into elbow 29E to extend downward into the water tank. This allows water flushing of the air hose between the water tank and the dosing tank using residual air pressure in the water tank.
6. Pipe 51 is inserted in hole 17J. Elbow 29D is then screwed to the threaded end of pipe 20A with its open end facing the far end of tank 3. Pipe 51 is then welded to tank 3 at hole 17J with the male threads remaining outside the tank, elbow 29D is welded to steel pad 33, and pad 33 is welded to the bottom of tank 3.
7. Pipe 47A is inserted in hole 171 so that its unthreaded end is ¾ inch from the inside bottom of tank 3, then welded to tank 3 at hole 17I with the male threads extending outside the tank.
8. Pipe 47B is inserted in hole 17F so that its unthreaded end is 1 inch from the inside bottom of tank 3, then welded to tank 3 at hole 17F with the male threads extending outside the tank.
9. The female end of elbow 29F is welded to tank 3 at hole 17H.
10. The base of pipe "T" 59B is welded to tank 3 at hole 17G.
11. Curved wall separator 9 is welded to tank 3. Tanks 3 and 5 are then welded together and attached to the septic truck frame.
12. Primary shutoff valve 11 is connected to hole 17A in tank 7. This shutoff valve may be bolted or welded to the tank. This standard manufactured valve encloses a hollow steel ball and a steel seat which operate as a shutoff when tank 7 is filled.
13. Pipe 45 is assembled with elbow 46 and nipple 44. This sub-assembly is inserted into dosing tank 7 via hole 17B. Nipple 44 extends a short distance outward through hole 17C, and is welded to the tank wall around hole 17C. The bottom of pipe 45 should be about ½ inch above the bottom of tank 7.
14. The unthreaded end of pipe 61 is welded to tank 7 at hole 17D.
15. An arm of pipe "T" 59A is welded to tank 7 at hole 17E.
16. Female threaded plug seat 15 is welded into hole 17B, and plug 13 is installed therein.
17. Tank 7 is mounted on the septic truck.
18. Ball valve 43E is screwed onto pipe elbow 27C.
19. Ball valve 43D is screwed onto pipe elbow 27B.
20. Hose barb 21A is screwed into ball valve 43E.
21. Hose barb 21B is screwed into ball valve 43D.
22. Hose barb 21 C is screwed into the connecting arm of primary shutoff valve 11.
23. High pressure/vacuum hose 35D is connected to hose barbs 21A and 21C.
24. Hose barb 21D is screwed into female pipe coupler 77B.
25. High pressure/vacuum hose 35E is connected to hose barbs 21B and 21D in such a manner that the hose has an "S" curvature. This is accomplished by using a hose longer than necessary to fill the space between the barbs. This curvature will cause the hose to flex when the dosing chamber tank 7 fills and seats the hollow steel ball in primary shutoff valve 11.

26. Ball valve 41B is screwed onto elbow 25A.
27. Quick coupler 23A is screwed into ball valve 41B.
28. Female end of elbow 25B is screwed onto the male threaded protruding end of pipe 47B.
29. Ball valve 41A is screwed onto the male end of elbow 25B.
30. Quick coupler 23B is screwed into ball valve 41A.
31. Air line ball valve 57A is screwed onto elbow 29E.
32. Hose barb 21J is screwed into airline ball valve 57A.
33. Air hose 71A is attached to hose barb 21J.
34. Hose barb 21K is screwed into an arm of pipe "T" 67A.
35. The open end of air hose 71 A is attached to hose barb 21K.
36. Hose barb 21N is screwed into the base of pipe "T" 67A.
37. Air hose 71B is attached to hose barb 21N.
38. Air line ball valve 57B is screwed onto male threads of pipe 61.
39. Hose barb 21M is screwed into airline ball valve 57B.
40. The open end of air hose 71B is attached to hose barb 21M.
41. Air valve 57C is screwed onto the male threaded end of elbow 29F.
42. Nipple 75C is screwed into pipe "T" 67B and air line ball valve 57C.
43. Nipple 75B is screwed into arms of pipe "T"s 67A and 67B.
44. Hose barb 21L is screwed into the remaining arm of pipe "T" 67B.
45. Air hose 37 is connected to pipe barb 21L and to the one way air valve 39 (one way valve 39 is connected to the truck-cab-mounted air pressure regulator and the truck's air tank ).
46. Nipples 73A and 73B are screwed into pipe "T" 59A.
47. Ball valve 43C is screwed onto nipple 73A.
48. Hose barb 21E is screwed into ball valve 43C.
49. Ball valve 43B is screwed onto nipple 73B.
50. Hose barb 21F is screwed into ball valve 43B.
51. Female pipe couplers 77A and 77B are screwed onto pipes 45 and 47A.
52. Hose barb 21I is screwed into female pipe coupler 77A.
53. High pressure/vacuum hose 35B is connected to hose barbs 21I and 21F.
54. Hose barbs 21G and 21H are screwed into pipe "T" 58B.
55. High pressure/vacuum hose 35C is connected to hose barbs 21G and 21E.
56. Ball valve 43A is screwed onto the male end of elbow 27A.
57. Hose barb 19 is screwed into the open end of ball valve 43A.
58. High pressure/vacuum hose 35A is connected to hose barbs 19 and 21H.
59. Pipe elbow 29A is screwed onto the protruding male threaded end of pipe 49 in such a manner that its open end faces toward the operator.
60. Pipe elbow 29C is screwed onto the protruding male threaded end of pipe 51 in such a manner that its open end faces toward the operator.
61. Ball valve 65A is screwed onto the male threaded end of pipe elbow 29A.
62. Ball valve 65B is screwed onto the male threaded end of pipe elbow 29C.
63. Nipple 75A is screwed into ball valve 65A and into the base of pipe "T" 55.
64. Water hose fitting 69 is screwed into the left-side arm of pipe "T" 55.
65. Pipe elbow 29B is screwed onto ball valve 65B.
66. Male threaded end of pipe 53A is attached to the open end of elbow 29B.
67. Pipe 53B is screwed into the open arm of "T" 55.
68. The male threaded ends of pipes 53A and 53B are screwed into pipe union 63.

The relative sizes of the slurry carrying tank 3 and the dosing tank 7 are preferably in a ratio of about 10/1, so that 10 doses are available before recharging the slurry carrying tank. The water tank should be large enough to provide water for flushing the invention, and for other general non-potable water uses as well. An example of effective tank sizes for an average septage hauler truck is: main tank 1000 gallons; slurry carrying tank 70 gallons; dosing tank 7 gallons; and water tank 50 gallons.

Operation of Lime Slurry Injection System

A. At a Staging Area, Fill the Lime Slurry and Water Containment and Carrying Tanks 3 and 5 as Follows:

1. Mix lime slurry in separate external slurry mixing and holding tank.
2. Attach a lime slurry loading hose to quick coupling connector 23B.
3. Insert lime slurry loading hose into slurry mixing and holding tank.
4. Close all ball valves in the lime slurry injection system.
5. Start septic pumping truck's main vacuum pump to create a vacuum in main septic pumping/hauling tank 1.
6. Open ball valve 43E to create a vacuum in dosing chamber tank 7.
7. Open ball valve 43C to create a vacuum in lime slurry containment tank 3.
8. Open ball valve 41A. Vacuum pulls line slurry into lime slurry containment and carrying tank 3. Allow this tank to fill.
9. Close ball valve 41A and disconnect slurry-loading hose from quick coupling connector 23B.
10. Attach a water loading hose to quick coupling connector 23A.
11. Insert water loading hose into separate external water supply.
12. Open ball valve 43A to create a vacuum in water containment and carrying tank 5.
13. Open ball valve 41B. Vacuum pulls water into water containment and carrying tank 5. Fill tank.
14. Close ball valve 43A.
15. Close ball valve 41B and disconnect water loading hose from quick coupling connector 23A.
16. Close ball valves 43C and 43E. Stop septic pumping truck's main vacuum pump. Water and line slurry containment and carrying tanks are filled.

When filling water and line slurry containment tanks 3 and 5, excess water and lime slurry often moves into dosing chamber tank 7. By opening ball valves 43D and 57B the vacuum in main septic pumping/hauling tank 1 and the air line pressure combine to inject that water and slurry into the main septic pumping/hauling tank 1. Then close ball valves 43D and 57B.

B. Treating Septage with Line Slurry at the Job Site

At the pumping site, use standard procedures to pump raw septage into the main septic hauling tank 1. When the in-ground septic tank is empty or the main septic pumping/hauling tank is full of raw septage, it is advisable to agitate the contained septage. By using the pumping truck's main vacuum system to blow and suck septage back and forth from the truck to the in-ground tank and back to the truck at least one time. It is most efficient to treat the septage with lime slurry while sucking inward the last flow of agitated septage. The simultaneous inflows of septage and lime slurry into the main tank 1 mix the two flows effectively.

1. Open ball valve 43E to allow for exhaust of air from dosing chamber tank 7 when it fills and to allow the vacuum in main septage hauling tank 1 to transfer to dosing chamber tank 7.

Figure 2:
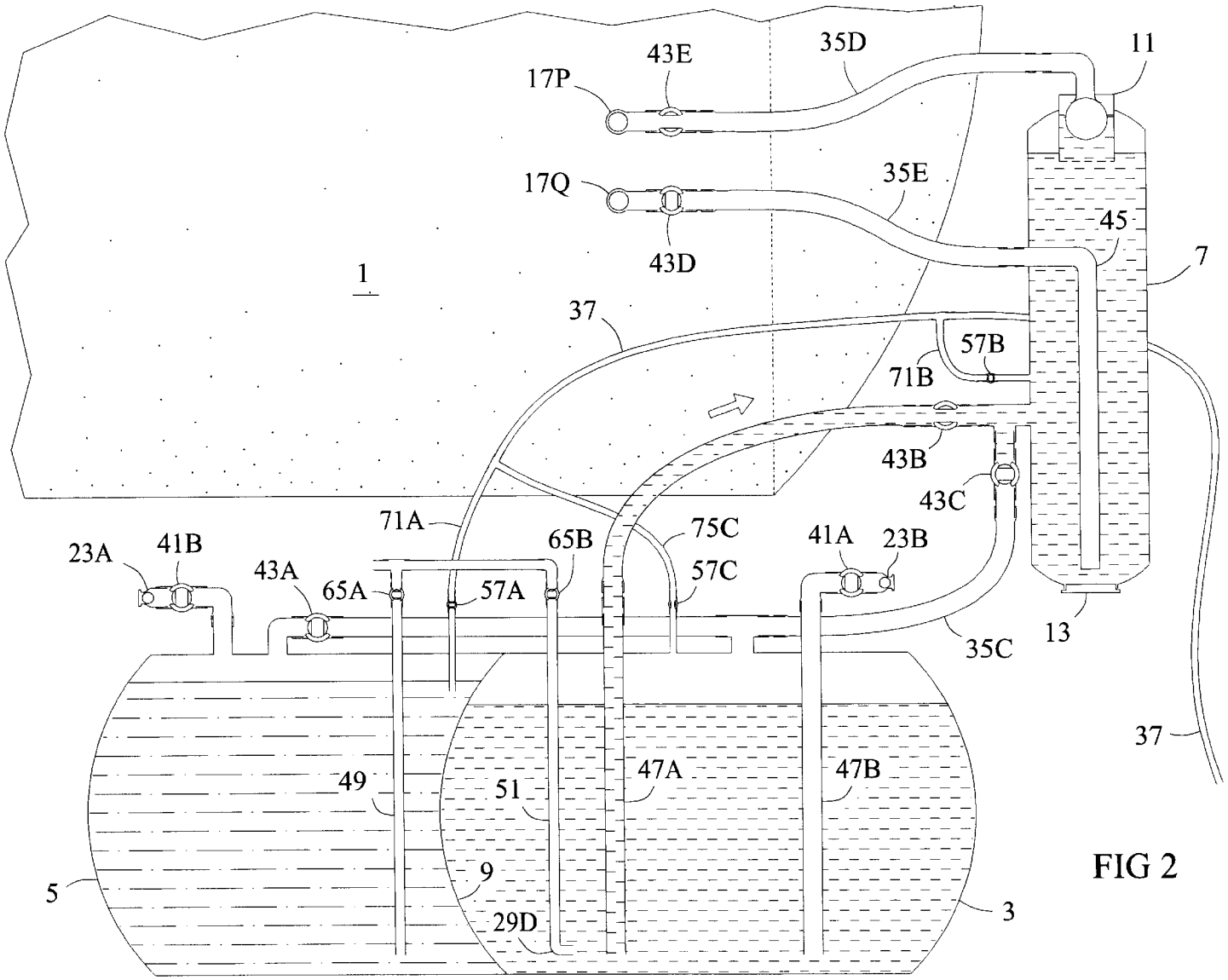
FIG. 2 is a schematic side view of the invention configured for transfer of slurry from lime slurry carrying tank 3 to dosing tank 7.
Figure 3:
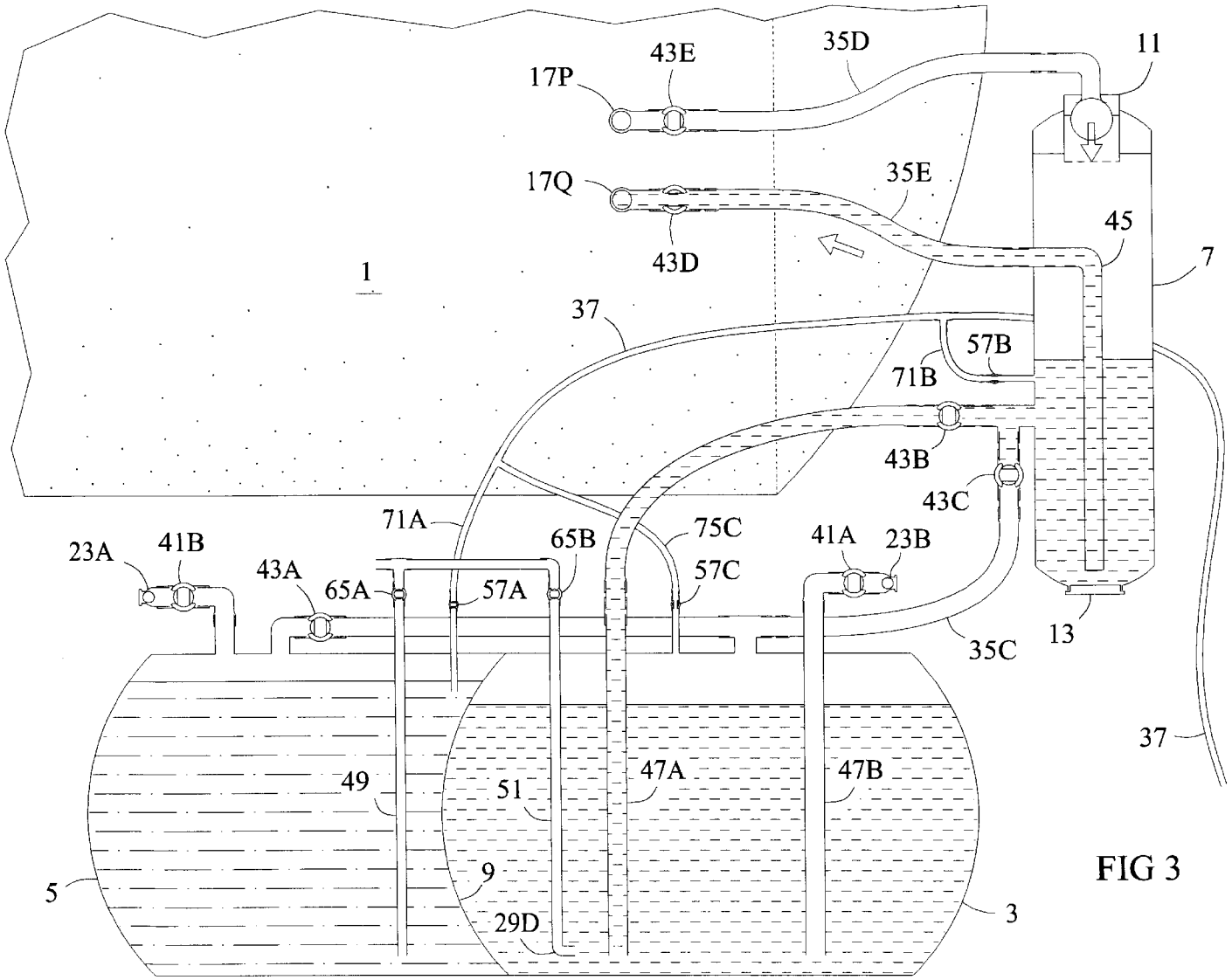
FIG. 3 is a schematic side view of the invention configured for transfer of slurry from dosing tank 7 to septage tank 1.
Figure 4:
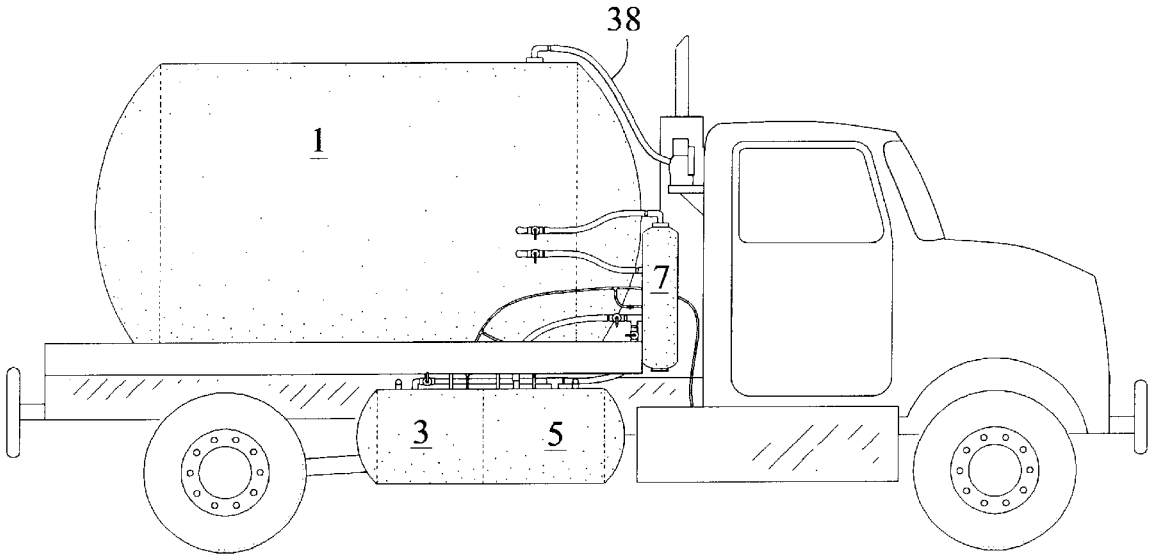
FIG. 4 is a side view of the invention as mounted on a septic truck.
Figure 5A:
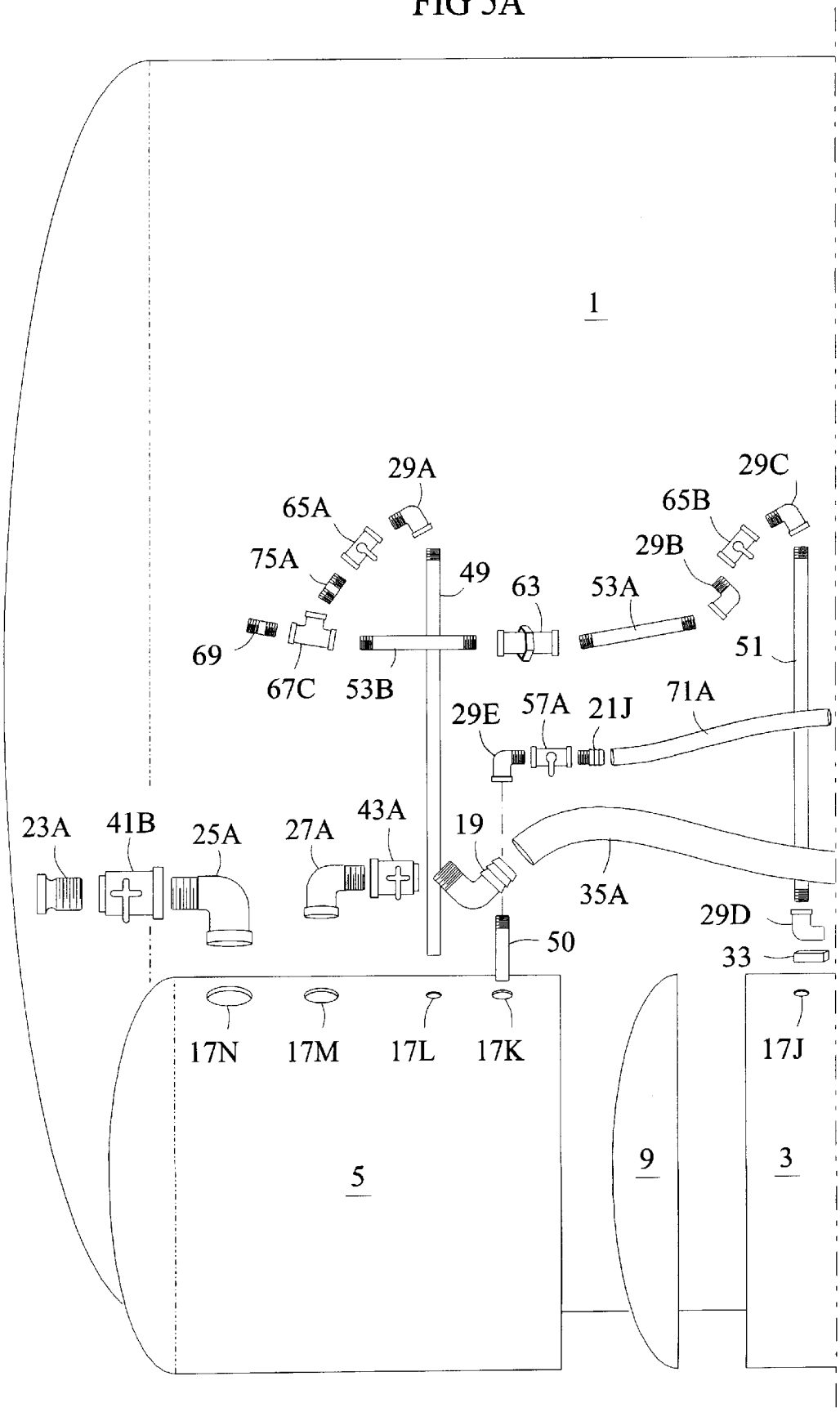
FIG. 5A is the left half of a suggested parts layout of the invention. Some of the parts are rotated from their assembled orientation in order to show the part in profile for easy identification. Refer to the description of the connections of the parts to understand their final positions.
Figure 5B:
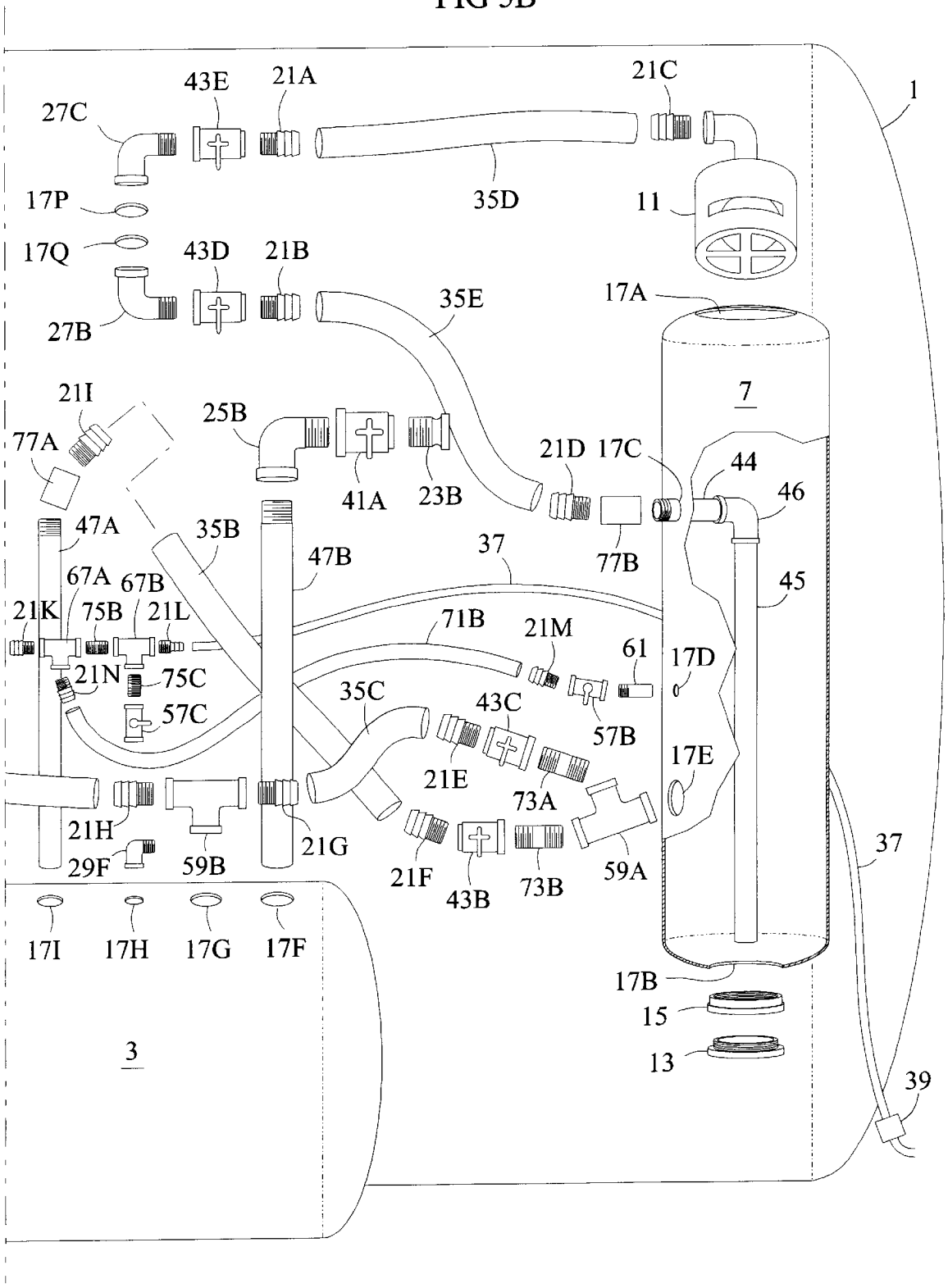
FIG. 5B is the right half of the parts layout view of the invention.

2. Open ball valve 57C to create air pressure in lime slurry containment and carrying tank 3.
3. Open ball valve 43B. Existing air pressure and vacuum forcefully transfer lime slurry from lime slurry containment and carrying tank 3 to dosing chamber tank 7. When dosing chamber tank 7 fills, the hollow steel ball in primary valve 11 will seat with an audible sound, and high pressure/vacuum hose 35E will flex when the ball seats. The sound and movement tell the operator the tank has filled. This step is shown in FIG. 2.
4. Close ball valves 43B, 43E, and 57C. Dosing chamber tank 7 is filled.
5. Open ball valve 57B to put air pressure on dosing chamber tank 7.
6. Open ball valve 43D. Line slurry is forcefully ejected from dosing chamber tank 7 into main septage hauling tank 1 by the combined forces of the vacuum in the main septage hauling tank and the air pressure in dosing chamber tank 7. When dosing chamber tank 7 empties, pressure changes will cause the hollow steel ball in primary shutoff valve 11 to drop with an audible sound, and high pressure/vacuum hose 35E will vibrate. The sound and movement tell the operator that the tank has emptied. This step is shown in FIG. 3.
7. Close all ball valves. The lime slurry injection system has now treated the raw septage in the main septage pumping/hauling tank 1.
8. Test ph of septage. When it meets EPA requirements, land spread it.

The dosing chamber tank 7 is sized to treat a load of approximately 1000 gallons. Multiple injections may be used as necessary. Partial loading of dosing chamber tank 7 can be accomplished by opening ball valves 43B and 57C while 43D and 43E are closed; the compression of air in dosing chamber tank 7 will only allow the tank to partially fill.

A major advantage of this system is its total flexibility of use. Fluid can be pushed through any conduit attached to any tank by air pressure. For example, a water hose is normally connected to nipple 69 for general rinsing around a job site by expelling water through the hose from tank 5 under air pressure. However, lime slurry can also be expelled through the water hose for treating spilled septage by spraying lime slurry on it. This is done by opening valve 57C to pressurize tank 3, then opening valve 65B. If a thinned slurry mix is desired for this purpose, valve 57A can be opened to pressurize the water tank 5, and valve 65A can then be opened as much as desired to mix water with the slurry being expelled through the hose.

C. Clean-Up at the End of the Day

If the lime slurry containment and carrying tank is partially full at end of job it may be emptied by attaching a lime slurry loading hose to quick coupling connector 23B, opening ball valve 57C to put air pressure on its contents, and slowly opening ball valve 41A to force the contained lime slurry back into a separate external slurry mixing and holding tank.

1. Open ball valves 57A, 65A, 65B, 43B, and 43D. The lime slurry injection system is back-flushed from the water containment and carrying tank 5 through lime slurry containment and carrying tank 3 and through dosing chamber tank 7 into main pumping/hauling tank 1. The positioning of pipe elbow 29D allows the force of moving water to effectively agitate lime which may settle on the bottom of lime slurry containment and carrying tank 3.
2. Close all valves. Shut down all equipment.
3. Steel plug 13 may be removed if necessary to clean the inside of dosing chamber tank 7.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

In the claims, "fluid" means any substance that can flow, including a liquid, gas, or slurry. A "fluid communication line" is a hollow line that may be controlled by valves. "Septage" is waste liquids and solids held in a septic tank, including sewage.

I claim:

1. A method of injecting lime slurry into a septage tank on a septage hauling truck, comprising the steps of:

a) mounting a lime slurry carrying tank and a smaller dosing tank on the truck;

b) providing a first fluid communication line with a valve between the dosing tank and the septage tank;

c) providing a second fluid communication line with a valve between the lime slurry carrying tank and the dosing tank;

d) providing means to increase air pressure in the slurry carrying tank;

e) providing means to increase air pressure in the dosing tank;

f) adding lime slurry to the lime slurry carrying tank;

g) moving a portion of lime slurry from the lime slurry carrying tank to the dosing tank through the first fluid communication line by increasing air pressure in the lime slurry carrying tank relative to the dosing tank;

h) transferring the portion of lime slurry in the dosing tank into the septage tank by increasing air pressure in the dosing tank relative to the septage tank;

whereby a discrete dose of lime slurry is injected into the septage tank.

2. A septage hauling truck of the type having a septage tank, the truck having an improvement for lime slurry injection by discrete doses into the septage tank, comprising:

a lime slurry carrying tank attached to the truck;

a lime slurry dosing tank attached to the truck, the dosing tank having a top end;

a first fluid communication line between the dosing tank and the septage tank;

a first valve in the first fluid communication line;

a second fluid communication line between the lime slurry carrying tank and the dosing tank;

a second valve in the second fluid communication line;

a source of compressed air on the truck;

a first compressed air line between the source of compressed air and the lime slurry carrying tank;

a third valve in the first compressed air line;

a second compressed air line between the source of compressed air and the dosing tank; and, a fourth valve in the second compressed air line;

whereby lime slurry can be transferred from the lime slurry carrying tank to the dosing tank, then from the dosing tank to the septage tank, by manipulating appropriate valves to apply compressed air to the source tank and open a fluid communication path between the source and destination tanks.

3. The septage hauling truck of claim 2, further comprising;

a fluid shutoff float valve on the top end of the dosing tank;

a third fluid communication line between the float valve and the septage tank; and a fifth valve in the third fluid communication line;

the float valve operating to close the third fluid communication line when the dosing tank is full of lime slurry;

whereby a transfer of lime slurry from the lime slurry carrying tank to the dosing tank will occur when the first valve is closed and the second, third, and fifth valves are open, and this slurry transfer will automatically stop when the dosing tank is full.

4. The septage hauling truck of claim 2, further comprising;

a water tank attached to the truck;

a fourth fluid communication line between the water tank and the lime slurry carrying tank;

a sixth valve in the fourth fluid communication line;

a third compressed air line between the compressed air source and the water tank; and a seventh valve in the third compressed air line;

whereby water can be carried to a job site in the water tank, and compressed air can be used to push water through the complete slurry path from the slurry carrying tank through the dosing tank to the septage tank, for rinsing lime slurry from the internal surfaces of the invention.

5. A lime slurry injection system for septic pumpers comprising:

a main septage pumping and hauling tank (1);

a source of partial air vacuum (38) attached to the main tank;

a lime slurry containment and carrying tank (3);

a lime slurry dosing tank (7) having a top, bottom, and side;

a float valve (11) attached to the top of the dosing tank that closes when the dosing tank fills with fluid;

a first fluid communication line (35D) between the main tank and the float valve for exhaust of air from the dosing tank;

a first shutoff valve (43E) in the first fluid communication line;

a second fluid communication line (35E) between the main tank and the dosing tank;

a second shutoff valve (43D) in the second fluid communication line;

a third fluid communication line (35B) between the slurry carrying tank and the dosing tank;

a third shutoff valve (43B) in the third fluid communication line;

a source of compressed air (37);

a fourth fluid communication line (75C) for compressed air between the source of compressed air and the slurry carrying tank;

a fourth shutoff valve (57C) in the fourth fluid communication line;

a fifth fluid communication line (71B) for compressed air between the source of compressed air and the dosing tank;

a fifth shutoff valve (57B) in the fifth fluid communication line; and a first fluid connection (23B) and a sixth shutoff valve (41A) on the slurry carrying tank for transferring lime slurry into the slurry carrying tank from an external source.

6. A method of injecting lime slurry into septage using the lime slurry injection system of claim 5, comprising:

connecting a hose from an external lime slurry source to the first fluid connection (23B);

creating a partial vacuum in the main tank (1);

opening the first shutoff valve (43E) to create a partial vacuum in the dosing tank (7);

opening the third shutoff valve (43B) to create a partial vacuum in the slurry carrying tank (3);

opening the sixth shutoff valve (41A) to draw lime slurry into the slurry carrying tank;

closing the sixth shutoff valve (41A);

opening the fourth shutoff valve (57C) to introduce air pressure into the slurry carrying tank (3);

opening the third shutoff valve (43B) to transfer slurry from the slurry carrying tank (3) to the dosing tank (7);

closing the first and third shutoff valves (43E, 43B) when the float valve (11) closes;

opening the fifth shutoff valve (57B) to put air pressure in the dosing tank (7); and opening the second shutoff valve (43D) to transfer lime slurry from the dosing tank (7) to the main tank (1);

whereby a measured dose of lime slurry is safely injected into the main tank (1).

7. The lime slurry injection system of claim 5, further comprising:

a water tank (5) attached to the lime slurry carrying tank;

a sixth fluid communication line (71A) for compressed air between the source of compressed air and the water tank;

a sixth shutoff valve (57A) in the sixth fluid communication line;

a seventh fluid communication line (49/53/51) for fluid communication between the water tank and the lime slurry carrying tank;

seventh and eighth shutoff valves (65A/65B) in the seventh fluid communication line; and a water hose connection (69) in the seventh fluid communication line between the seventh and eighth valves.

* * * * *